United States Patent [19]

Wassilieff

[11] 4,132,332

[45] Jan. 2, 1979

[54] CONTAINERS FOR PRESSURIZED FLUIDS, IN PARTICULAR FOR DISPENSING AEROSOLS

[76] Inventor: Victor Wassilieff, 84, Rue de l'Assomption, 75016 Paris, France

[21] Appl. No.: 790,680

[22] Filed: Apr. 25, 1977

Related U.S. Application Data

[63] Continuation of Ser. No. 414,135, Nov. 8, 1973, abandoned.

[30] Foreign Application Priority Data

Nov. 14, 1972 [FR] France ..... 72.40290

[51] Int. Cl.[2] ..... B65B 3/04; B65D 83/14

[52] U.S. Cl. ..... 222/387; 141/3; 222/389; 222/518

[58] Field of Search ..... 222/389, 387, 212, 206, 222/209, 401, 394, 398, 402.1, 402.12, 518; 141/2, 3, 20

[56] References Cited

U.S. PATENT DOCUMENTS

| | | | |
|---|---|---|---|
| 1,648,163 | 11/1927 | Childs | 222/389 X |
| 1,911,972 | 5/1933 | Rose | 222/398 |
| 2,809,774 | 10/1957 | Kaye et al. | 222/389 X |
| 3,096,001 | 7/1963 | Boe et al. | 222/518 X |
| 3,268,123 | 8/1966 | Spatz | 222/398 X |
| 3,327,906 | 6/1967 | Gomann | 222/389 |
| 3,468,308 | 9/1969 | Bierman | 222/212 X |
| 3,498,506 | 3/1970 | Charrier | 222/402.12 |

*Primary Examiner*—Robert B. Reeves
*Assistant Examiner*—Francis J. Bartuska
*Attorney, Agent, or Firm*—Charles E. Brown

[57] ABSTRACT

Containers for dispensing pressurized fluids, such as aerosols, comprise a space for the fluid and a wall movable automatically to reduce the volume of the space as the contents become exhausted, a vacuum chamber being arranged in communication with at least a part of the movable wall in such a manner as to maintain the pressure on the pressurized fluid at a substantially constant level. A spring may be provided to act on the movable wall so as to apply pressure to the pressurized fluid, in which case the vacuum chamber is arranged to act in opposition to the spring and to reduce its effect as the spring extends. Alternatively the spring may be omitted and the fluid space and vacuum chamber may be arranged to vary in volume in the same sense, the vacuum acting on the movable wall to apply pressure to the pressurized fluid.

38 Claims, 9 Drawing Figures

FIG.3
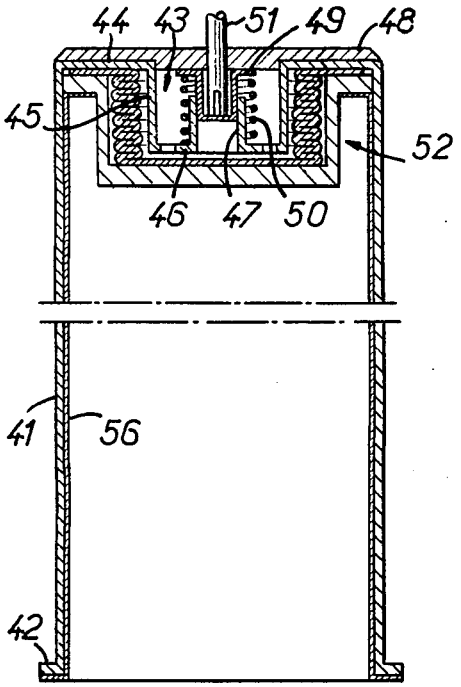
FIG.4
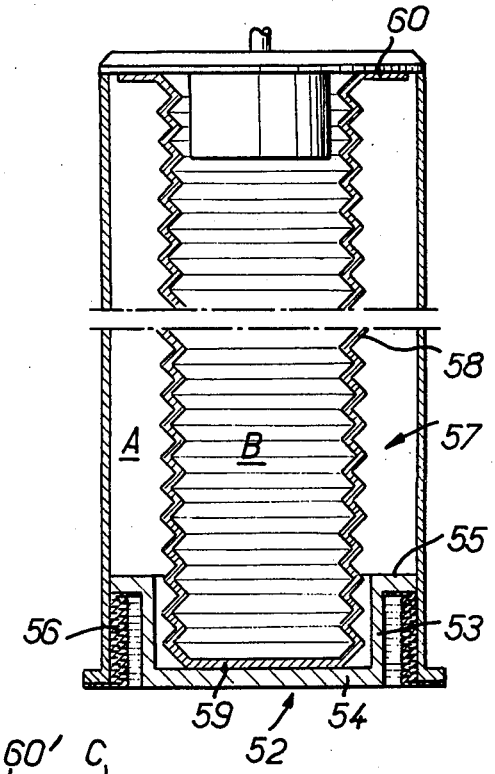
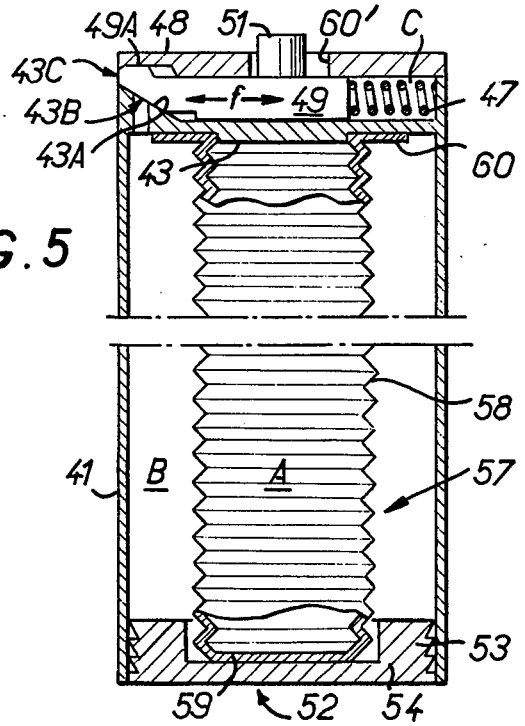
FIG.5

CONTAINERS FOR PRESSURIZED FLUIDS, IN PARTICULAR FOR DISPENSING AEROSOLS

This is a continuation of application Ser. No. 414,135 filed Nov. 8, 1973, now abandoned.

BACKGROUND OF THE INVENTION

1. Field of the Invention

The present invention relates to containers for pressurized fluids, in particular for dispensing aerosols.

2. Description of the Prior Art

It is known that in aerosol containers the inner pressure tends to reduce as the container becomes exhausted. This constitutes a disadvantage, particularly as the end of the period of use approaches. It is an object of the present invention to remedy this drawback.

Furthermore, in containers inside which pressure is obtained by the injection of gas, the latter involves considerable expenditure both of raw material and of equipment.

Moreover, the use of gas is not always suitable for it sometimes involves the danger of harming the quality of the packed product, more particularly in the case of foodstuffs.

In addition, the known containers for pressurized fluids, in particular aerosols, do not supply any visual indication of the extent to which they are filled. This may give rise to fraud, in the case of containers offered for sale and said to be new, or to filling defects undetected at the packing station, and to which the provision of a pilfer-proof device supplies no remedy. Furthermore, the lack of visual indication means that the container may become exhausted in unexpected manner, leaving the user in want.

SUMMARY OF THE INVENTION

The present invention has for its object to eliminate these drawbacks and, more particularly, to produce a pressurized fluid container kept at a suitable pressure throughout its period of use, permitting the elimination of the use of gas, although not excluding the possibility of using it, and thus enjoying a wider field of application, and in certain embodiments supplying at all times a visual indication of the extent to which the container is filled, thus rendering unnecessary, in particular cases, the fitting of a tamper-proof band.

According to the invention, a container for pressurized fluid comprises an envelope delimiting a space for the fluid and having a wall designed to move automatically so as to reduce the volume of the space as the contents become exhausted, wherein a vacuum chamber is disposed so as to create a vacuum on at least a part of said wall.

Within the scope of the invention there is meant by the term "fluid" any liquid, semi-liquid, paste, powdery or other product, with or without gas, fulfilling the required condition for have a state of at least partly hydrostatic pressure.

In one construction according to the invention, the movable wall is subjected to the action of a spring the effect of which is to reduce the volume of the space as the contents become exhausted, and an inlet permits the introduction of air into the vacuum chamber, in an amount sufficient to exert upon the movable wall a force which adds itself to the force of the spring and which makes it possible to compensate, at least in part, for the reduction suffered by the latter as a result of the progressive release of the spring.

In this construction, the inlet permitting the introduction of air into the vacuum chamber may be controlled through the actuating device of a valve used to ensure the distribution of the pressurized fluid.

Advantageously, the entry of air into the chamber under vacuum is controlled by the pressure prevailing in the fluid space, which permits an automatic adjustment of said pressure, and keeping it at a constant value.

In a second construction according to the invention, the movable wall presents to the open air a face situated oppositely to the face exposed to the vacuum chamber and is thus subjected, throughout the period of use of the container, to a constant differential pressure, that is to say to a constant force which ensures also a constant value for the pessure of the fluid in the space.

According to an advantageous form of this last construction, the movable wall comprises a rigid wall, slidably mounted in a cylinder open at one end, and a flexible wall, preferably deformable in the manner of a bellows constituting a side wall of the space. The unit thus constituted has an inner space, surrounded by the bellows, and an annular space, delimited by the bellows and by the cylinder, the fluid being introduced into one of these spaces, and the vacuum being created in the other.

According to another form of this second construction, a container according to the invention is obtained by the assembly of two elements slidably mounted in relation to each other and forming two chambers, the respective volumes of which are adapted to vary in the same sense as a function of the relative positions of these two elements, one of the said chambers being adapted to receive the pressurized fluid while the other chamber is arranged in such a way that the vacuum can be created in it.

The present invention has also for its object to provide improvements to valve dispensers normally mounted on pressurized fluid containers of the kind contemplated hereinabove. In the known dispensers, a wall of the space containing the fluid has an outlet aperture, the outside orifice of which communicates with the outlet opening of the dispenser through a duct, or equivalent flow space, adapted to be blocked or released according to the position of the valve. Blocking generally takes place at an intermediate point of the passage duct, so that, in the gaps between dispensing periods the portion of duct situated between the blocking point and the outlet opening of the dispenser remains filled with a certain stagnant amount of packed product which, being exposed to the ambient atmosphere, may present risks as regards quality and hygiene.

The invention eliminates this drawback with the aid of a dispensing valve adapted to fill completely, during a blocking period, the duct or flow space for the fluid provided between the outlet opening of the space containing the fluid and the outlet opening of the dispenser.

In suitable manner, the outlet opening of the space containing the fluid is off centre in relation to the axis of the container, the effect of this being to reduce the length of flow passage between the two openings.

In advantageous manner, the valve is in contact with the face bearing the outlet opening of the space for the fluid, along a direction slanting in relation to that followed by the valve in assuming its closed position, the valve being thus pressed against this face by a wedge effect. which ensures a fluid-tight closing of the space for the fluid, during the times between periods of use.

BRIEF DESCRIPTION OF THE DRAWINGS

FIGS. 3 and 4 show two different states of another container with a chamber for pressurized fluid and a vacuum chamber, the fluid being kept pressurized as a result of the action of atmospheric pressure;

FIG. 5 shows a modification of the construction of FIGS. 3 and 4;

DETAILED DESCRIPTION OF THE INVENTION

Figure 1:
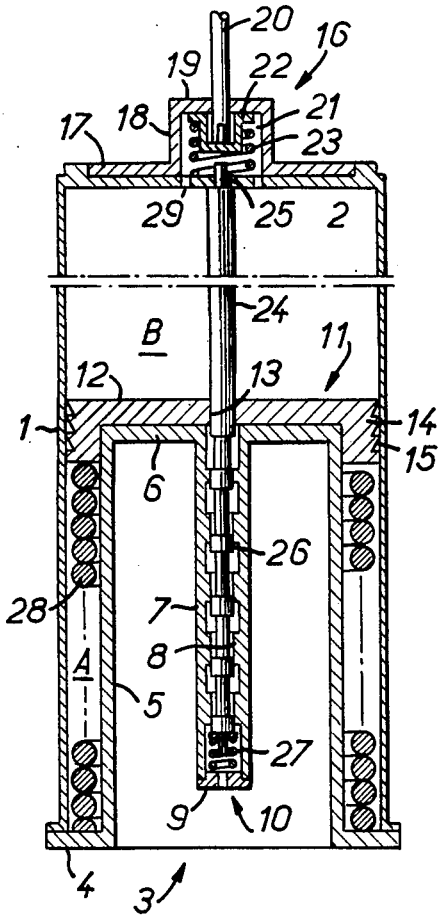
FIG. 1 shows in axial cross-section a container for aerosols comprising a chamber of pressurized fluid and a vacuum chamber, the fluid being kept pressurized by a spring and the vacuum chamber being provided with an air inlet controlled by a manually-operated valve.

In FIG. 1, a container for pressurized fluid has a cylindrical envelope 1 having a vertical axis, sealed at the top by an integral transverse wall 2, and, at its bottom part by a separate bottom element 3, to which it is joined by its bottom edge to form a fluid-tight joint.

Bottom element 3 has in axial cross-section a profile like a top hat, with a bottom edge 4 welded to the bottom edge of the envelope 1, a cylindrical body 5, housed inside the envelope 1, and a flat upper wall 6, in the form of a disc.

A vertical sleeve 7, formed integral with the bottom element 3 projects downwards from the lower surface of the upper wall 6. The inside bore of the sleeve 7 continues right through the upper wall 6 and has, on its inner face, a series of projecting annular zones 8, regularly spaced along the axis of the sleeve. The sleeve 7 is closed, at its bottom end, by a flat disc 9, which is perforated by a central hole 10.

An intermediate transverse wall or partition 11, slidably mounted in the manner of a piston in the cylindrical envelope 1, has a horizontal flat centre portion 12, with a central hole 13, and an annular portion 14 formed integral with the portion 12 and depending downwardly therefrom. The external surface 15 of the annular portion 14 has in axial cross-section a saw-tooth profile.

Upon the upper flat wall 2 of the container there is superimposed an element 16, having in axial cross-section a top-hat shaped profile, with a bottom edge 17, resting on wall 2, a cylindrical body 18, and an upper flat wall 19 through which a hollow rod 20 with vertical axis passes, forming part of a known dispenser for pressurized fluid.

In the cylindrical chamber 21, delimited by elements 2 and 16, an element 22 in the shape of a dish bears, by its upper edge, against the lower face of the wall 19. The rod 20, going through the wall 19, rests on the bottom of the dish 22. A coil spring 23 abuts by its lower end against the upper face of the wall 2 and, by its upper end, against the edge of the dish 22, which is thus compressed against the bottom face of the wall 19.

A solid rod 24, disposed along the axis of the container, abuts by its top end against the lower face of the wall 2. From its upper abutting face, a pin 25 of smaller diameter projects through the wall 2, into the cylindrical chamber 21.

The bottom part of the rod 24, housed in the sleeve 7, has on its side face annular projecting zones 26, regularly spaced along the vertical axis and which, in the state of FIG. 1, are in liquid-tight contact, by their peripheral faces, with the internal peripheral faces of the corresponding projections 8 formed inside the sleeve.

Rod 24 ends at its bottom end in one of the projecting zones 26 which abuts against the upper end of a spiral spring 27, the lower end of which rests against the disc 9 which closes the sleeve 7.

The space delimited by the envelope 1, sealed at the top and bottom, is divided into two chambers A and B by the intermediate partition 11. The bottom chamber A, of annular shape, adapted so that a vacuum can be created in it, receives a spiral spring 28 which surrounds the cylindrical body 5 of the bottom element 3, and the top and bottom ends of which rest respectively against the intermediate partition 11 and the lower edge 4.

The peripheral surface 15 of the partition 11 is arranged with tight jointing in relation to the inner face of the envelope 1, to oppose any communication between chambers A and B, and this fluid-tightness is facilitated by the release chambers formed by the serrations of the surface 15 with the corresponding face of envelope 1.

The upper chamber B, delimiting a volume of cylindrical shape is therefore adapted to receive a pressurized fluid.

In the condition of FIG. 1, chamber B has been filled and a vacuum prevails in chamber A. The intermediate partition 11 is therefore compressed against — or simply held in contact with — the upper wall 6 of the bottom element 3, in spite of the action of the compressed spring 28 which tends to push it back upwards.

Chamber B is in communication by means of an orifice 29, made through the upper wall 2, with the small cylindrical chamber 21, and the conditions are thus achieved to enable the dispensing of pressurized fluid to be made in known manner, the assembly 20, 22 constituting a spring-loaded valve which opens when rod 20 is pressed and closes again by spring action when the pressure is released. In the event of the fluid filling pressure being just sufficient to maintain the contact between the partition 11 and the wall 6, this pressure corresponds in absolute value with the force of the spring 28, as a vacuum has been created in chamber A. The actual initial pressure of the packed product is therefore equal to that corresponding to the force of the spring, less one atmosphere. This affords therefore the possibility of increasing the actual pressure of the fluid, by breaking the vacuum in chamber A, and the invention takes advantage of this possibility, as will be shown in the following description of the method of operation of the container.

In operation, the exhaustion of the pressurized fluid in chamber B has the effect of forcing the intermediate partition 11 upwards, under the action of spring 28, the absolute pressure of the fluid remaining equal to that supplied by the spring, However, the force exerted by the spring reduces as it is gradually released. There would therefore be a gradual reduction of the absolute pressure and, to compensate this loss, it is possible to press on the hollow dispensing rod 20, and push down rod 24, acting upon the pin 25, to the extent required for the separation of the annular projections 26, on the rod, from the annular projections 8, on the sleeve 7, and put temporarily an end to the tight contact between these projections, which enables the outside air to enter through hole 10 into the sleeve 7, and to reach chamber A. As soon as the upper rod 20 is released, the action of the return spring 27 causes rod 24 to go up again and restores the fluid-tight contact between the projections 26 and 7, which puts an end to the partial filling of chamber A. The gradual filling of chamber A, in the course of the use of the container, therefore constitutes a store which compensates for the gradual loss through the relase of the force of the spring 28.

Should the initial filling pressure of the chamber B be greater, in absolute value, than that required to hold the spring 28 shortened down to its maximum (condition of FIG. 1), the partition 11 is compressed by force against the wall 6, but the foregoing method of operation retains its validity after an initial period of use, during which the pressure of the fluid reduces down to the absolute value corresponding to the maximum force of the spring 28.

Figure 2:
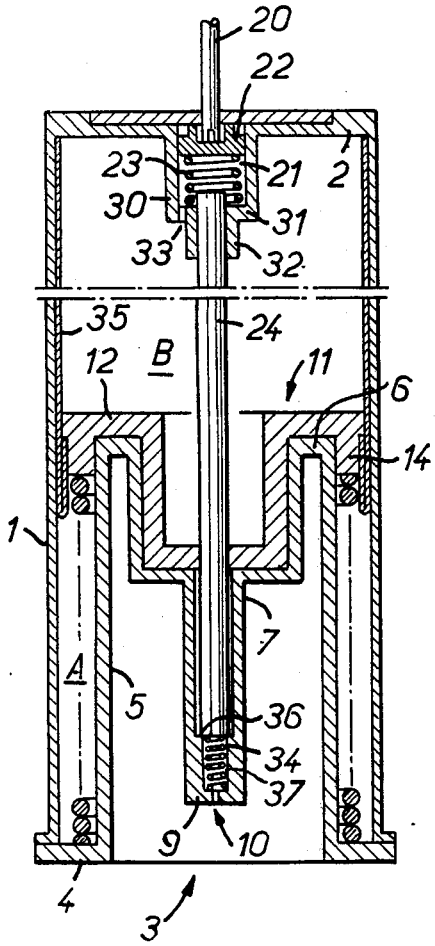
FIG. 2 shows a modification of the construction of FIG. 1 with valve automatically controlled by the pressure of the stored fluid.

The construction of FIG. 2 exhibits some of the elements of the construction of FIG. 1, denoted by the same reference numbers.

In FIG. 2 the fluid-tightness between chambers A and B is achieved by means of a flexible sheath 35, of fluid-tight material, and which, connected by its upper end to the bottom face of the wall 2, lines the internal cylindrical face of the chamber B, enters the chamber A through a peripheral interstice between the envelope 1 and the partition 11, then folds back upwards to join in fluid-tight joint manner by its opposite end with the partition 11.

The bowl 22 of the dispensing valve 20, 22, as well as the return spring 23 of this valve, are received in a cylindrical chamber 21, similar to that which has been previously described, but formed here on the lower face of wall 2. For this purpose, an element 30 in the form of a sleeve with vertical axis formed integral with the wall 2, projects downwards, starting on the lower face of said wall, and extends, at its lower end, into a coaxial sleeve 32 of smaller diameter, a flat element 31 forming a connection area between these two sleeves. A hole 33 which is made through wall 31 places chambers B and 21 in communication.

A rod 24, occupying a position similar to that of rod 24 peviously described, but of uniform diameter throughout its height, goes through the sleeve 32 and the wall 31 to enter by means of its upper end the chamber 21. Passing through partition 11, it passes with play through sleeve 7 and rests, by its lower end, on an annular step 36 formed on the inner face of said sleeve. The inner bore of the sleeve thus extends, below the step 36, into a portion of smaller inner bore, closed by a lower end wall 9 perforated with a hole 10 and forming with said wall a cylindrical chamber 37 which receives a coil spring 34 tensioned between the wall 9 and the lower face of rod 24.

The pressure prevailing in chamber B enters chamber 21 and, being exerted against the top face of rod 24, tends to keep it pressed against the step 36 while the spring 34 exerts upon the rod an oppositely-directed action which has a tendency to raise it.

As long as the rod 24 presses against the step 36, with which it is designed to form a fluid-tight joint, the chamber A is unable to communicate with the outside. The initial filling pressure of chamber B must therefore be at least equal to that required to overcome the force of the spring 37. This is also necessary to permit the creation of a vacuum in chamber A. This initial pressure is also sufficient to maintain the partition 11 pressed by force or simple contact against the wall 6. When the pressure falls in chamber B, through the exhaustion of the fluid, to the point of enabling spring 34 to raise rod 24, rod 24 rises, chamber A receives through hole 10 and along sleeve 7 air coming from outside, the pressure of which, being added to that supplied by the spring 28, causes pressure to rise in chamber B, and this entry of outside air continues until the pressure in chamber B becomes sufficient to bring rod 24 back against step 36.

As in the previously described construction, the initial vacuum in chamber A makes it therefore possible to compensate, during use, for the loss through the relaxation of the effort exerted by the spring 28 to maintain a satisfactory pressure in chamber B, but this compensation takes place here automatically, as the displacements of the inlet valve, constituted by the rod 24, are controlled by the pressure of chamber B, and the calibration force of the spring 34, instead of being done manually.

To enable the element 12 to move upwards until it comes in contact with the wall 2, and thus ensure the almost complete exhaustion of the chamber B, the elements 12 and 6 have bowl-shaped central recesses, designed to cover the downward projection formed on element 2 by sleeves 30 and 32.

In FIGS. 3 and 4 which represent, in two different states, another construction according to the invention, a cylindrical envelope 41, with vertical axis and open lower end provided with an out-turned flange 42, is sealed at its upper portion by an element 43 in the shape of a bowl, formed integral with it and having, starting from the upper edge of the envelope 41, a flat annular portion 44, a downwardly-directed cylindrical body 45, and a flat bottom 46. The bottom 46 has a central hole provided with a flange 47 in the form of an upwardly-directed sleeve.

A flat cover element 48 covers the bowl and a valve 49 of known type, in the shape of a hollow die, inserted so as to be vertically axially slidable in the sleeve 47, is kept pressed against the lower face of the cover 48 by a return coil spring 50 which presses against the bottom of the bowl 43. The movements of the valve 49 are controlled by a hollow dispensing rod 51, this also being of known type.

An element 52, with a bowl profile dimensioned to cover amply from below the bowl profile of the element 43, presents a cylindrical body 53, a flat bottom 54 and a peripheral edge 55, turned radially outwards. Element 52 is mounted so as to slide, in the manner of a piston, in the envelope 41.

In FIG. 3 the element 52 is in the position it adopts when forced upwards to the maximum extent in the envelope 41. A fluid-tight flexible sheath 56, open at both ends, is connected by its upper end, turned inwards, with the lower face of the edge 55 of the element 52 and, by its bottom end, folded outwards, to the lower face of the edge 42 of the envelope 1. In the state of FIG. 1, the sheath 56 lines, between its two folded ends, the inside face of envelope 1.

Another fluid-tight sheath 57, having a side wall 58 deformable in the manner of a bellows, is sealed at its bottom end by a bottom 59 fixed on the upper face of the bottom 54 of the element 52, whereas its open top end is provided with an edge 60, radially turned outwards and fixed to the bottom face of the element 44 solid with the envelope 1. It will be appreciated that the capability of deformation of the two elements 56 and 57, each of which is connected by its two respective ends to the parts 41 and 52, permits the displacements of the piston 52 in the envelope 41, between its two extreme positions represented on FIGS. 3 and 4.

Sheath 57 delimits a chamber B with variable volume and forms, with envelope 41, an annular chamber A, itself also of variable volume, which surrounds chamber B. The choice of material of sheaths 56, 57, as well as their method of assembly to the elements of the envelope 41 and of the piston 52 ensures the fluid-tightness of chambers A and B, both between each other and in relation to the outside.

In the condition of FIG. 3, these two chambers are at minimum capacity. If, starting from this condition, pressurized fluid is introduced into chamber B, chamber B increases gradually in volume, pushing the piston 52 downwards, and a vacuum is created in chamber A, itself also being compelled to increase the volume, without, however, being able to communicate with the outside. The condition of FIG. 4 is thus reached, which constitutes a container of pressurized fluid, duly filled and ready to be used.

This container is used in known manner, by the operation of the dispensing valve 49. As the stored product becomes exhausted, the volume of chambers A and B decreases to return gradually to the condition of FIG. 3, the pressure in chamber B remaining meanwhile practially constant and equal to the initial filling pressure, seeing that, of the two forces which maintain the equilibrium of piston 52, one is a function of the pressure prevailing in chamber B, and the other of the atmospheric pressure acting upon the outer face of the piston. This construction has the advantage, over the foregoing constructions, of not requiring a spring for maintaining the compression of chamber B, as well as of not requiring any special operation to create a vacuum in chamber A, a vacuum being created in it automatically by the filling of chamber B.

The construction of FIG. 5 reproduces, in equivalent manner, certain elements of the foregoing construction, denoted by the same reference numbers. The sheath 56 is is eliminated. The annular chamber, denoted by the reference B, receives the pressurized fluid, and its fluid-tightness with the outside is achieved by the serrated profile of the lateral face of piston 52, disposed in sliding contact with the inner wall of envelope 41. It is the inside chamber A in which a vacuum is created by the filling of chamber B. The upper sealing element 43 of the envelope 41 has a flat shape and defines, with the cover 48, a horizontally elongated chamber which receives a slide valve 49, loaded by a spring 47, and operated by a knob 51, movable horizontally in an elongated orifice 60' of the cover 48.

The passage orifice formed in the element 43 and ending in the orifice 43B is well off centre in relation to the axis of the container and occupies a position very close to that of the final orifice 43C. This shortens considerably the path of the fluid between these two openings, as compared with the known devices, and reduces the amount of product ejected through the closure of the valve, while contributing to the hygienic conservation of the product during the period of use and until exhaustion.

The device loses practically none of its efficiency. If the valve does not completely fill the path space situated between the two openings, that is to say if it stops in its closing movement to the left a little before reaching opening 43B, as the non-ejected material represents then only a very small amount, easily accessible, and, anyhow, there remains no product trapped between the cover 48 and the end wall 43.

The alternating movements of the valve 49 in the directions of opening and closure are indicated by the twin-headed arrow f.

The upper face of the sealing element 43, which defines the lower face of the horizontally elongated chamber C in which the valve 49 moves, is horizontal, that is to say parallel with the arrow f, along the greater part of its extent, and ends, on the left as seen in FIG. 5, in a flat part 43A, inclined in relation to the said arrow. In line with the inclined portion 43A the wall 43 has an orifice through the external opening 43B of which the product stored in the chamber B can come out, when the valve is pulled towards the right, to fill the space thus freed on the left by the valve in the horizontally elongated chamber C, and flow out through a distribution opening 43C formed on the outside of the container. When the valve 49 is released, it moves leftwards, under the action of the spring 57, again fills completely the space it had freed in chamber C, in such a way as to ensure the complete outward expulsion of all the product which had come out through orifice 43B, and its end, provided with an upper horizontal face 49A and a lower inclined face, parallel with face 43A, lodges itself in the manner of a wedge between the elements 48 and 43 and compresses itself against the face 43A, which ensures a fluid-tight closure of the orifice 43B.

Figure 6:
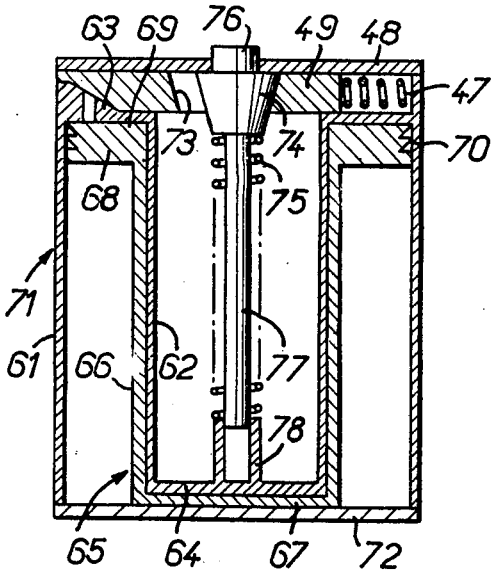
FIGS. 6 and 7 show in two positions another modification of the construction of FIGS. 3 and 4.
Figure 7:
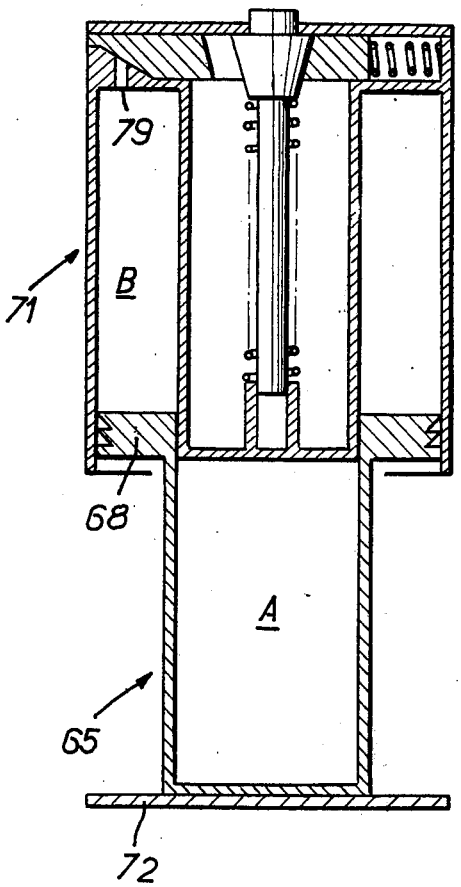

According to the embodiment of FIGS. 6 and 7, which represent another construction according to the invention in two different positions, two co-axial cylindrical walls 61 and 62, the latter situated inside the former, are connected at their upper edges by a flat annular element 63, the space delimited by the inner cylindrical wall 62 being closed, at the lower end of the latter, by a flat wall 64.

The envelope 71, which is formed by elements 61, 62, 63 and 64, thus forms an annular space inside which is mounted, in the manner of a piston, an element 65 composed of a cylindrical sleeve 66, adapted to slide in fluid-tight manner on the outer cylindrical face of the element 62, of a transverse flat bottom wall 67, forming a lower sealing bottom for the cylindrical space delimited by the sleeve 66, and of a wall 68, forming an outer collar on the upper edge of the sleeve 66. The wall 68 has an upper flat face adapted to come in contact with the bottom flat face of annular element 63, and an outer annular face 70, showing in axial cross-section a serrated profile and adapted to come in sliding contact with the inner face of the cylindrical wall 61.

A separate plate 72, attached to the lower face of the bottom 67, constitutes a suppoting base.

The two end positions of the piston 65 in the envelope 71 are represented in the respective FIGS. 6 and 7. As will be clearly seen from FIG. 7, these two elements delimit between them a cylindrical chamber A which the sleeve 66, sealed by the bottom wall 67, forms with the wall 64, and an annular chamber B, provided with an outlet opening 79, and which the wall 68 of the piston forms with the coaxial sleeves 61, 62 and the transverse wall 63.

In the end position represented in FIG. 6 there is flat contact between the elements 63, 68 on the one hand and the elements 64, 67 on the other hand, the volume of Chamber A being then practically equal to zero, in the same way as that of chamber B. If, starting from this condition, pressurized fluid is introduced into the annular chamber B, the volume of the latter increases pushing the piston element 65 downwards, and a vacuum is created in chamber A which, also increasing in volume, has however no means of communication with the outside. There is thus obtained the state of FIG. 7 in which the piston element 65 is in equilibrium between, on the one hand, the force exerted by the pressurized fluid on the upper flat face of the wall 68 and, on the other hand, the atmospheric pressure exerted on the bottom flat face of the wall 68 and the lower flat face of the bottom wall 67. During the utilisation of the dispenser container, the amount of fluid in the chamber B gradually reduces, but its pressure remains constant, seeing that the force which is exerted on the outer face of the piston element 65 remains invariable. The exhaustion of the container results therefore in a progressive rise of the piston element 65.

A cover 48 forms with the element 63 a housing adapted to receive a slide valve 49, used to screen the hole 79. The valve 49, loaded by the spring 47, is of the type described in the construction of FIG. 5 and effects, like the latter, a tight closure as well as a good protection of the non-distributed product. However, in the construction of FIGS. 6 and 7, the valve 49 has a hole 73 in which is located a bush in the shape of a truncated cone 74, converging downwards, the small bottom face of which rests on the upper end of a coil spring 75 which itself rests, by its bottom end, on the bottom wall 64 of the sleeve 62. The bush in the shape of a truncated cone 74 carries, projecting from its upper larger face, a pin 76 which goes through the cover 48. It is therefore possible to lower the bush 74 by pressing on the pin 76, its return to the initial position being ensured by the return spring 75, when the pin is released.

The side face of the opening 73 has the same taper as the side face of the bush 74, and the latter is in contact with face 73 only along a limited section, situated on the right as seen in FIG. 6. The lowering of the truncated cone 74 produces therefore, by a wedge effect, a horizontal displacement from left to right of the slide valve 49, thereby allowing the pressurized fluid to come out via hole 79, the return spring 47 returning the valve 49 into the closing position when the pin 76 is released.

As will be seen from the drawing, the stability of the control member 74 of the valve 49 is ensured by a vertical rod 77 which extends the element 74 downwards to be received in a housing 78, constituted by a sleeve formed as a projection on the upper face of the bottom wall 64. Rod 77 serves in addition as an abutment for the springs 75.

The container represented in FIGS. 6 and 7 is therefore substantially achieved by the assembly of two elements one of which constitutes a piston chamber (elements 61,62,63) and a piston (elements 62,64) while the other forms an annular piston (68) and a piston chamber (elements 66,67), the chamber and the piston of one of these parts being respectively adapted to the piston and chamber of the other, and the relative axial movement of these two parts being calculated to produce variations in the same direction in the volume of the two chambers.

It will be understood that it is possible to obtain the same result, for the purpose of the manufacture of a container of pressurized fluid, designed to keep constant the pressure of the fluid during its period of use, by assembling, as an alternative, two parts one of which forms two piston chambers and the other two pistons adapted respectively to these two chambers.

This alternative, relating to the construction of FIGS. 6 and 7 constitutes, however, only one of those which may be the subject of the arrangements described and represented, as well as their methods of utilisation, without on that score departing from the scope of the invention.

Thus, as far as the methods of utilisation are concerned, it is possible to apply from outside two opposite forces on the envelope and on the mobile wall acting as a piston, in the constructions of FIGS. 3 to 7, so as to increase the volume of chambers A and B, and to fill the chamber B with the fluid to be packed by simple gravity, without feeding the latter at the pressure required to create a vacuum in chamber A.

Figure 8:
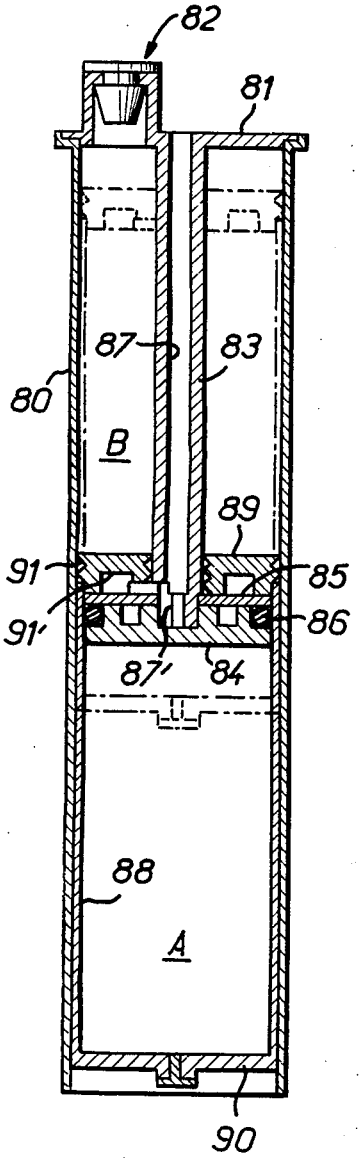
FIGS. 8 and 9 illustrate two further embodiments of the invention.

According to the modified embodiment shown in FIG. 8, a casing for a pressurised fluid container is composed of an outer sleeve 80 closed at its top end by a fluid-tight wall 81 forming a lid, and provided with a distributor 82, which will not be described in detail because it may be of a known type.

A vertical rod 83 fastened on and projecting from the bottom face of the lid 81 is disposed coaxially with the sleeve 80, inside and extending over a part of the height of the latter. The rod 83 carries at its bottom end an element 84 in the form of a disc, on which rests a washer-like element 85. The assembly comprising the two elements 84,85 has a peripheral groove (not given a reference) in which is received a seal ring 86. The rod 83 is pierced over its entire height by a coaxial bore 87, which at its top end leads into the open air, and the annular portion of the rod surrounding this bore is provided at the bottom with a slot 87' which leads laterally into the surrounding space.

A movable wall, in the form of a cylindrical hollow body, is composed of an internal sleeve 88 provided with a top transverse wall 89 and a bottom transverse wall 90. The sleeve 88 is mounted for sliding inside the sleeve 80, its transverse walls 89, 90 being situated one on each side of the fixed partition formed by the assembly 84, 85 annular clearance (not given a reference) being left between the periphery of the latter and the inner face of the sleeve 80.

The upper movable wall 89 has a central hole which enables it to slide along the rod 83 and which has, both on the sliding face of this hole and on its peripheral face 91 which slides on the inner face of the sleeve 80, saw-tooth-shaped profiles which form expansion chambers and, in accordance with known arrangements, constitute fluid-tight sliding seals. The upper wall 89 is in addition provided on its bottom face with a cavity 91', which in the state shown in FIG. 8, is in communication with the open air through the slot 87' and the bore 87.

The fluid-tight bottom wall 90 is integrally moulded with the inner sleeve 88. The upper wall 89 and the fixed lid 81 bound between them a fluid chamber B inside the fixed sleeve 80. With regard to the movable wall 90, it bounds together with the fixed partition 84, 85 a vacuum chamber A inside the movable sleeve 88.

The two chambers A and B are adapted to vary simultaneously in volume, in the same direction, by the sliding of the sleeve 88 in the sleeve 80. The position corresponding to the maximum volume of these two chambers is shown in solid lines in FIG. 8. In addition, the movable walls 89, 90 are shown in broken lines, in an intermediate position, which corresponds for example to the commencement of filling of the chamber B.

At the commencement of this filling operation, there is contact between the wall 89 and the lid 81, and also between the wall 90 and partition 84, 85. The container is filled through the device 82. The fluid under pressure pushes the wall 89 downwards, driving out through the bore 87 the air which is situated between it and the fixed partition 84, 85. At the same time the wall 90 is forced downwards, creating a vacuum between it and the fixed partition 84,85.

In the course of use the movable walls gradually move upwards, that is to say in the opposite direction, the position in broken lines then representing a state close to the end of the period of use of the container, that is to say the exhaustion of its chamber B.

Once the chamber has been filled through the lowering of the wall 89 and the contact made by it with the washer 85, the presence of the rod 83, which acts as a tie-rod between the lid 81 and the part 84, makes it possible for the fluid to be super-compressed, that is to say enables it to be given a pressure higher than that required to form the vacuum in the chamber A. An equivalent effect can be achieved in the previous embodiments, for example those illustrated in FIGS. 6 and 7, by providing the wall 61 with a bottom rim radially directed towards the inside, in order to effect positive arresting of the downward movement of the piston 65 during filling.

To return to FIG. 8, the outer casing 80 has the axial length required to mask the movable hollow element entirely from sight, except from below, thus giving the container the usual appearance of aerosol dispensers.

Figure 9:
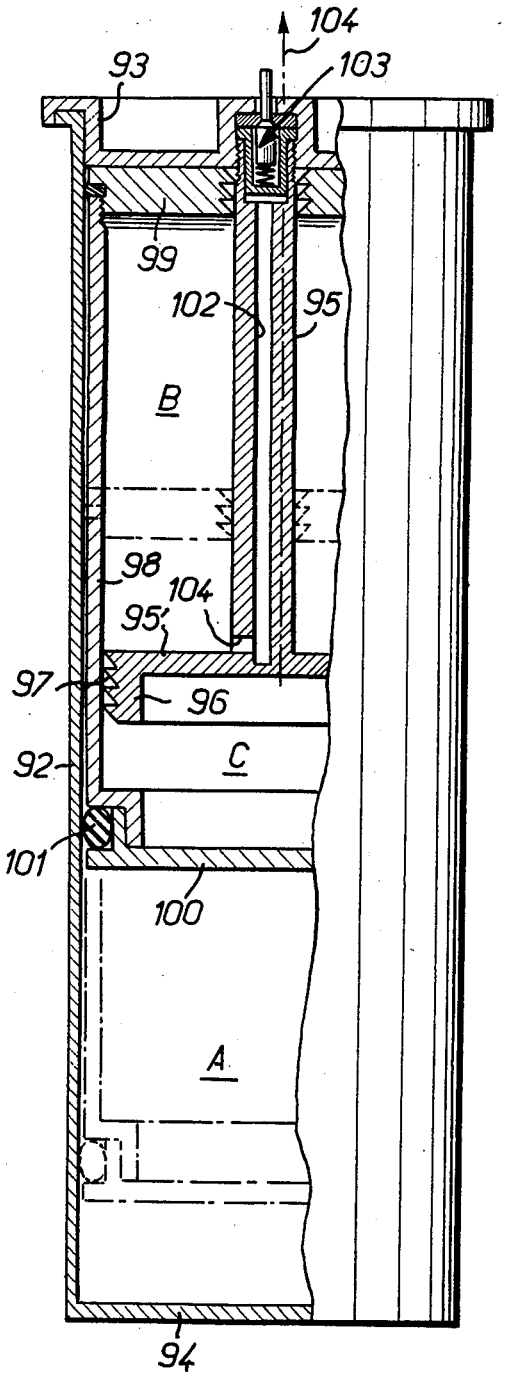

In FIG. 9, a casing is composed of an outer sleeve 92 provided with a perforated lid 93 and a fluid-tight bottom 94. A vertical rod 95 fixed on and projecting from the inner face of the lid 93, and disposed on the axis of the sleeve 92, carries at its bottom end a transverse partition 95' in the form of a disc, with a peripheral rim 96 the outer peripheral face 97 of which has a sawtooth-shaped profile of the kind described above. The partition 95' occupies an intermediate position, situated about halfway between the lid 93 and bottom 94, at least in the example illustrated.

A displaceable wall is composed of a sleeve 98 mounted for sliding inside the sleeve 92, and provided with an upper transverse wall 99 and a bottom transverse wall 100. The walls 99 and 100 being situated one on each side of the partition 95', the sliding movement is made possible by annular clearance provided between the inner face of the sleeve 92 and the outer annular face 97 of the partition 95'.

The wall 99 has a central hole whose inner face, which has a sawtooth-shaped profile, forms a sliding fluid-tight seal with the outer face of the rod 94. With regard to the wall 100, it forms with the sleeve 98 an annular groove (not given a reference), which is provided with a sealing ring 101.

The rod 95 has a central bore 102 which is in communication through the top with a device 103 for filling and distributing pressurised fluid, and a bottom radial hole 104 which brings the bore 103 into communication with the space situated between the wall 99 and partition 95'. At the commencement of the filling phase, the wall 99 and partition 95' are in contact and during filling through the elements 103, 102, and 104 the wall 99 is raised to form between it and the partition 95' a fluid chamber B of progressively increasing volume, which is shown in solid lines in FIG. 9. Simultaneously the wall 100 is raised, moving away from the bottom 94, in order to form between it and the latter a vacuum chamber A inside the fixed sleeve 92, and moving towards the partition 95' to form with it a compressed air chamber C inside the movable sleeve 98. The relative or effective fluid storage pressure is therefore substantially equal to the difference in absolute pressure between the compartments A and C.

In the course of utilisation, the assembly 98,99,100 is moved downwards in proportion as the chamber B is exhausted. But whereas in FIG. 8 the distribution pressure remains constant practically until exhaustion, this pressure gradually declines in the apparatus shown in FIG. 9, because of the progressive expansion of the air imprisoned in the chamber C. Here again, the presence of the tie-rod element 95 permits supercompression of the product in the course of the filling.

The arrangements described in the present specification and illustrated in the accompanying drawings may naturally undergo various modifications and variations, without thereby departing from the spirit of the invention.

In a modification of the apparatus shown in FIG. 9, a vent, shown diagrammatically as a dot-and-dash line, enabling the space between the elements 95' and 100 to come into communication with the outside, prevents the creation of a compressed air chamber. In this case we have once again an apparatus similar to that shown in FIG. 8, but with transposition of the directions of movement of the movable hollow body during the filling and utilisation phases.

Also, a modification of the construction of FIG. 8 could, for example, comprise coupling the two movable walls 89,90 by an axial rod similar to 83 instead of by the sleeve 88. This rod could then slide through the fixed internal partition 84, which would itself be directly united around its periphery to the outer sleeve 80.

It is clear from the foregoing that, unlike known containers which offer a chamber of constant volume for the stored fluid and can effect the distribution of the latter only be means of compressed gas, the containers arranged according to the invention, the fluid capacity of which progressively decreases in the course of use, enable the fluid to be kept at a suitable pressure without the use of gas, which represents a considerable saving in raw materials and in equipment and may in certain cases provide advantages in respect of quality of the product.

I claim:

1. A container for pressurized fluid, comprising an envelope delimiting the space for the fluid and said envelope having an axis and including a movable wall designed to move automatically along said axis so as to reduce the volume of the space as the contents become exhausted, pressure means for exerting a positive pressure on said movable wall to continuously urge a reduction of the space, said pressure means including a vacuum chamber disposed so as to create a vacuum operable on at least a part of said movable wall, the space for the pressurized fluid and the vacuum chamber being disposed on opposite sides of the movable wall, said pressure means include resilient means separate and apart from said wall exerting on the wall a force opposed to that exerted on the latter by the pressurized fluid, means for introducing air into the vacuum chamber, so as to compensate for the reduction by release of the force exerted on the movable wall by the resilient means, and the means for the introduction of air are controlled by a device used to effect the dispensing of the pressurized fluid.

2. A container according to claim 1, wherein the dispensing device comprises a valve with two ranges of operation, one for dispensing the pressurized fluid and another more pronounced to actuate a valve controlling the entry of air into the vacuum chamber.

3. A container for pressurized fluid, comprising an envelope delimiting the space for the fluid and said envelope having an axis and including a movable wall designed to move automatically along said axis so as to reduce the volume of the space as the contents become exhausted, pressure means for exerting a positive pressure on said movable wall to continuously urge a reduction of the space, said pressure means including a vacuum chamber disposed so as to create a vacuum operable on at least a part of said movable wall, the space for the pressurized fluid and the vacuum chamber being disposed on opposite sides of the movable wall, said pressure means include resilient means separate and apart from said wall exerting on the wall a force opposed to that exerted on the latter by the pressurized fluid, means for introducing air into the vacuum chamber, so as to compensate for the reduction by release of the force exerted on the movable wall by the resilient means, and the entry of air into the vacuum chamber is controlled by a valve held in closing position by the pressure prevailing in the space for the fluid.

4. A container for pressurized fluid, comprising an envelope delimiting the space for the fluid and said envelope having an axis and including a movable wall designed to move automatically along said axid so as to reduce the volume of the space as the contents become exhausted, pressure means for exerting a positive pressure on said movable wall to continuously urge a reduction of the space, said pressure means including a vacuum chamber disposed so as to create a vacuum operable on at least a part of said movable wall, the space for pressurizing fluid and the vacuum chamber being disposed on opposite sides of the movable wall, said pressure means including resilient means separate and apart from said wall exerting on the wall a force opposed to that exerted on the latter by the pressurized fluid, and the vacuum chamber is annular shaped and acts as a housing for the resilient means formed by a coil spring.

5. A container for pressurized fluid, comprising an envelope delimiting the space for the fluid and said envelope having an axis and including a movable wall designed to move automatically along said axis so as to reduce the volume of the space as the contents become exhausted, pressure means for exerting a positive pressure on said movable wall to continuously urge a reduction of the space, said pressure means including a vacuum chamber disposed so as to create a vacuum operable on at least a part of said movable wall, the space for the pressurized fluid and the vacuum chamber being disposed on opposite sides of the movable wall, said pressure means including resilient means separate and apart from said wall exerting on the wall a force opposed to that exerted on the latter by the pressurized fluid, the envelope being a cylindrical envelope having a sealing wall at both ends, the movable wall being slidably mounted in the cylindrical envelope between the sealing walls, the space for the fluid and the vacuum chamber being formed inside the envelope, on opposite sides of the movable wall, and fluid-tight sealing between the space for the fluid and the vacuum chamber is achieved by a flexible sheath fixed by its two respective ends to the movable wall and to one of the sealing walls.

6. A container for pressurized fluid, comprising an envelope delimiting the space for the fluid and said envelope having an axis and including a movable wall designed to move automatically along said axis so as to reduce the volume of the space as the contents become exhausted, pressure means for exerting a positive pressure on said movable wall to continuously urge a reduction of the space, said pressure means including a vacuum chamber disposed so as to create a vacuum operable on at least a part of said movable wall, the space for the fluid and the vacuum chamber are situated on the same side of the movable wall, a flexible wall able to extend and contract along the axis of movement of the movable wall and ensuring the separation between the space for the fluid and the vacuum chamber, the ability of the flexible wall to extend and contract is afforded by its flexibility, and the movable wall is slidably mounted in the manner of a piston in a cylindrical envelope sealed by a cover at one end, the flexible wall being a sheath in the form of a bellows fixed by its two respective ends to the cover and to the piston to delimit an internal space, surrounded by an annular space, usable as desired one as the space for the fluid, the other as the vacuum chamber.

7. A container according to claim 6, in which the fluid-tightness of the annular space at the sliding joint of the piston is achieved by a flexible sheath fixed by its two respective ends to the piston and to the cylindrical wall.

8. A container for pressurized fluid, comprising an envelope delimiting a space for the fluid and having a wall designed to move automatically so as to reduce the volume of the space as the contents become exhausted, wherein a vacuum chamber is disposed so as to create a vacuum on at least a part of said wall, the movable wall has a first surface and a second surface which are exposed respectively to the fluid and to a vacuum, and having the same orientation relative to the axis of movement of the movable wall, a casing comprising an outer sleeve and two transverse walls, and wherein the movable wall is a hollow body formed of an inner sleeve sliding in the outer sleeve and of two transverse walls situated one on each side of a transverse wall of the casing, which forms a partition therein, an annular space being left between the periphery of the transverse partition and the inner surface of the outer sleeve, the transverse walls of the hollow body forming with respective transverse walls of the casing two chambers, the volume of which is variable simultaneously in the same sense through the displacement of the hollow body, one of these chambers being for the pressurized fluid and the other being the vacuum chamber.

9. A container according to claim 8, hwerein the outer sleeve has an axial length substantially equal to the sum of the axial lengths of the two chambers when the latter are at their maximum volume.

10. A container according to claim 8, in which the transverse wall of the casing associated with the vacuum chamber forms a fluid-tight bottom for the casing, the transverse partition being associated with the fluid chamber.

11. A container for pressurized fluid, comprising an envelope delimiting the space for the fluid and said envelope having an axis and including a movable wall designed to move automatically along said axis so as to reduce the volume of the space as the contents become exhausted, pressure means for exerting a positive pressure on said movable wall to continuously urge a reduction of the space, said pressure means including a vacuum chamber disposed so as to create a vacuum operable on at least a part of said movable wall, and the space for the fluid and the vacuum chamber are situated on the same side of the movable wall, wherein said means includes a compressed gas chamber, wherein the dispensable wall has a third surface exposed to the compressed gas and directed oppositely to the first and second surfaces and said casing comprises an outer sleeve with two end walls and an intermediate partition, an annular clearance being left between the periphery of the intermediate partition and the inner face of the outer sleeve, and wherein the movable wall is a hollow body formed of an inner sleeve mounted for sliding in the outer sleeve, and of two walls situated one on each side of the said intermediate partition, one of the two walls of the hollow body forming the said fluid chamber between it and the intermediate partition, while the other wall of the hollow body situated between the intermediate partition and the adjacent end wall, axially bounds with the said intermediate partition and end wall two respective chambers one of which is the vacuum chamber and the other the compressed gas chamber.

12. A container according to claim 11, in which the transverse wall of the casing associated with the fluid chamber forms a fluid-tight lid for the casing, the transverse partition being associated with the vacuum chamber.

13. A process for packing pressurized fluid into a container of the type comprising a chamber for pressurized fluid and a chamber for holding vacuum therein, having at least two components mounted mobile relative to each other along an axis of movement to change the volumes of said chambers, wherein each of said chambers has two axially spaced primary and secondary wall means, said two chambers being formed respectively by said two primary and said two secondary wall means, wherein the primary and secondary wall means of one of said chambers are connected by a tie located at least in part in one of said chambers, said process comprising the steps of giving the wall means the position corresponding to minimum volume for both chambers, and filling one of the chambers with pressurized fluid and thus automatically creating a vacuum in the other of the chambers.

14. A process for packing fluid in a container for pressurized fluid comprising an envelope delimiting a space for the fluid and having a wall designed to move automatically so as to reduce the volume of the space as the contents become exhausted, wherein a vacuum chamber is disposed so as to create a vacuum on at least a part of said wall, said process comprising the steps of giving the movable wall the position corresponding to the minimum volume for both the fluid space and the vacuum chamber, and introducing pressurized fluid into the fluid space and thus automatically creating a vacuum in the vacuum chamber.

15. A container for distributing pressurized flowable material, said container comprising a first chamber for receiving the material, provided with a valve-controlled outlet and a first mobile wall portion, and a variable volume self-contained vacuum second chamber for holding vacuum provided with a second mobile wall portion having two opposite faces which are exposed one to sub-stmospheric pressure from the vacuum chamber and the other to at least atmospheric pressure, with means linking said mobile wall portions together for simultaneous movement so as to cause simultaneous variations of the same sign in the volumes of both chambers, whereby the combined effect of said sub-atmospherica pressure and at least atmospheric pressure on said second wall portion is operative through the agency of said first wall portion in permanently pressurizing material in the first chamber and causing a quantity thereof to be ejected from said first chamber when said valve-controlled outlet is open, each such ejection causing simultaneous reductions in volume in both first and second chambers, with the material left in the first chamber after each such ejection remaining pressurized.

16. A container according to claim 15, wherein said wall portions are mobile along an axis of movement and wall means are porvided generally parallel to said axis for partitioning said container into said first and second chambers, said wall means being extensible along a direction parallel to said axis.

17. A container according to claim 16, wherein said wall means are flexible along said direction.

18. A container according to claim 16, wherein said wall means have two mutually telescoping elements.

19. A container according to claim 17, having a cylindrical envelope sealed by a cover at one end and a piston slidingly mounted therein, wherein said flexible wall means consist of a sheath in the form of a bellows fixed by its two respective ends to the cover and to the piston to delimit an internal space surrounded by an annular space, usable as desired one for the first and the other for the second chamber.

20. A container according to claim 19 having a flexible sheath fixed at one end thereof to the piston and at the other end thereof to the envelope with said other end positioned remote from the cover, whereby fluid-tightness of the annular space is ensured.

21. A container according to claim 15 formed of an assembly of two elements one of which constitutes a piston chamber and a piston while the other forms a piston and a piston chamber respectively adapted to the piston chamber and the piston of the first element, said piston chambers forming as desired one the first and the other the second said chamber.

22. A container according to claim 15 formed of an assembly of two elements one of which constitutes two pistons and the other two piston chambers respectively receiving the pistons of the first elements, said piston chambers forming as desired one the first and the other the second said chamber.

23. A container according to claim 21, wherein said piston chambers are one of cylindrical and the other of annular shape.

24. A container according to claim 15 wherein the first chamber has an annular shape formed around an axis and is provided at one axial end thereof with a first axially directed passageway leading to a second radially and outwardly directed passageway, terminating into said valve-controlled outlet, with a valve member fitted into said second passageway.

25. A container according to claim 24 wherein the valve member has a wedge-shaped portion mating with a wedge-shaped portion of the second passageway.

26. A container according to claim 24 wherein the valve member is mounted within the second passageway for radially directed reciprocating movement.

27. A container according to claim 15, having a casing comprising an outer sleeve and first and second transverse walls, with an annular gap left between the periphery of the second wall and the inner face of the outer sleeve, and a hollow body comprising an inner sleeve adapted to slide along an axis in the outer sleeve through said gap and provided with third and fourth transverse walls positioned on either side of the second wall, one of said chambers being defined by the outer sleeve together with the first and third transverse walls while the other said chamber is defined by the inner sleeve together with the second and fourth transverse walls.

28. A container according to claim 27 wherein the outer sleeve has an axial length substantially equal to the sum of the axial lengths of the two chambers when the latter are both at maximum volume.

29. A container according to claim 15 further provided with a third chamber for containing a compressed gas.

30. A container according to claim 27 further provided with a third chamber for containing a compressed gas, said second mobile wall portion having one face exposed to gas from said third chamber.

31. A container according to claim 30 wherein said third chamber is axially delimited by two of said first, second, third and fourth transverse walls.

32. A container according to claim 27 wherein said first transverse wall forms a fluid tight cover for the casing and is associated with the first chamber for material.

33. A container according to claim 30 wherein said first wall forms a fluid tight bottom for the casing and is associated with the second chamber for holding vacuum.

34. A container according to claim 15 wherein said wall portions are mobile along an axis of movement, said container having at least two components mounted mobile relative to each other along said axis, each of said elements having two axially spaced primary and secondary wall means, said two chambers being axially delimited respectively by said two primary and said two secondary wall means, wherein the primary and secondary wall means of one of said elements are connected by a tie located at lease in part in one of said chambers.

35. A container according to claim 34 wherein said tie is a rodlike component located in said axis of movement.

36. A container according to claim 34 wherein the primary and secondary wall means of said other element are connected by a sleevelike tie component forming casing for the container.

37. A process for packing pressurized flowable material into a container of the type comprising a first chamber for receiving the material and provided with a valve-controlled outlet and a first mobile wall portion and a second chamber for holding vacuum provided with a second mobile wall portion having two opposite faces which are exposed one to the second chamber and the other to at least atmospheric pressure, with means linking said mobile wall portions together for simultaneous movement between one position of minimum volume of both chambers and another position of maximum volume of both chambers, said process consisting in giving both mobile wall portions the position corresponding to minimum volume for both chambers and filling the first chamber with pressurized flowable material thereby automatically creating a vacuum in the second chamber.

38. A process for packing pressurized flowable material into a container of the type comprising a first chamber for receiving the material and provided with a valve-controlled outlet and a first mobile wall portion and a second chamber for holding vacuum provided with a second mobile wall portion having two opposite faces which are exposed one to the second chamber and the other to at least atmospheric pressure, with means linking said mobile wall portions together for simultaneous movement between one position of minimum volume of both chambers and another position of maximum volume of both chambers, said process consisting in applying to the mobile wall portions a force sufficient to distend the vacuum chamber by overcoming the at least atmospheric pressure acting on the second mobile wall portion, thereby simultaneously distending the first chamber, filling the first chamber with flowable material, and releasing said force whereby said material becomes pressurized.

* * * * *